US007552760B1

(12) United States Patent
Ben Lakhdhar et al.

(10) Patent No.: US 7,552,760 B1
(45) Date of Patent: Jun. 30, 2009

(54) METAL FIN FOR AIR HEAT EXCHANGER

(75) Inventors: Mohamed Ali Ben Lakhdhar, Bourgoin-Jallieu (FR); Alain Compingt, Grezieu la Varenne (FR); Ira Zelman Richter, Lilburn, GA (US)

(73) Assignee: LGL France, Mions (FR)

( * ) Notice: Subject to any disclaimer, the term of this patent is extended or adjusted under 35 U.S.C. 154(b) by 0 days.

(21) Appl. No.: 10/597,371

(22) PCT Filed: Feb. 4, 2005

(86) PCT No.: PCT/FR2005/000254

§ 371 (c)(1),
(2), (4) Date: Oct. 4, 2006

(87) PCT Pub. No.: WO2005/083347

PCT Pub. Date: Sep. 9, 2005

(30) Foreign Application Priority Data

Feb. 6, 2004 (FR) ..... 04 01169

(51) Int. Cl.
*F28D 1/04* (2006.01)
*F28F 13/12* (2006.01)
*F28F 1/30* (2006.01)

(52) U.S. Cl. ..... 165/151; 165/109.1; 165/182

(58) Field of Classification Search ..... 165/151, 165/152, 161, 109.1, 181, 182
See application file for complete search history.

(56) References Cited

U.S. PATENT DOCUMENTS

| | | | | |
|---|---|---|---|---|
| 1,775,041 | A * | 9/1930 | Karmazin | 165/151 |
| 2,804,286 | A * | 8/1957 | Pintarelli | 165/182 |
| 4,434,846 | A | 3/1984 | Lu | |
| 4,465,128 | A | 8/1984 | Krekacs et al. | |
| 4,830,102 | A * | 5/1989 | Bakay et al. | 165/151 |
| 5,318,112 | A * | 6/1994 | Gopin | 165/151 |
| 5,628,362 | A | 5/1997 | Rew et al. | |
| 6,349,761 | B1 | 2/2002 | Liu et al. | |
| 6,578,627 | B1 * | 6/2003 | Liu et al. | 165/109.1 |
| 2004/0194936 | A1 * | 10/2004 | Torii | 165/151 |

FOREIGN PATENT DOCUMENTS

| | | |
|---|---|---|
| FR | 2417742 | 9/1979 |
| GB | 576864 | 4/1946 |
| JP | 58099691 | 6/1983 |
| JP | 59210297 | 11/1984 |

* cited by examiner

*Primary Examiner*—Tho V Duong
(74) *Attorney, Agent, or Firm*—Dennison, Schultz & MacDonald

(57) ABSTRACT

The invention concerns a metal fin for heat exchanger with tubes, comprising means for increasing heat transfers consisting of diverting conformations (10,11) each arranged upstream and downstream of an aperture (3) when considering the direction (F) of air flow, to force the air to pass either side of said aperture, the upstream (10) and downstream (11) diverting conformations of two superimposed apertures (3) belonging to one same column extending along a determined length so that they substantially rejoin at the plane of extension (P) of offset apertures. (Figure to be published: FIG. 2).

6 Claims, 2 Drawing Sheets

METAL FIN FOR AIR HEAT EXCHANGER

This application is a filing under 35 USC 371 of PCT/FR2005/000254, filed Feb. 4, 2005.

BACKGROUND OF THE INVENTION

The present invention pertains to the technical area of air heat exchangers and finds application in the sphere of heat exchangers in their general meaning.

The subject of the invention more particularly concerns the metal fins used in heat exchangers, mechanically assembled to tubes to form indirect transfer surfaces intended to increase the heat exchange surface areas between firstly tubes in which a first cold or hot liquid circulates and secondly a second fluid such as air which circulates between the tubes and along the surfaces of the fins in a determined flow direction.

These fins are generally made in the form of plates arranged parallel to each other and spaced apart over a determined pitch in relation to the intended application. Tubes pass through these fins to which the fins are crimpled via a mechanical or hydraulic process.

For dry surface exchangers, the global coefficient of heat transfer chiefly depends on air velocity, the ratio of the airside and fluid side surface areas, and on the efficacy of the fins. An efficient fin translates as an airside thermal resistance that is as low as possible (or an airside heat transfer coefficient as high as possible) whilst having the lowest possible air pressure loss.

In the prior art, various forms of embodiment of fins are known. One first known type is a fin in the form of a planar plate. This planar fin has the advantage of having very low pressure drop. However, the disadvantage of this planar fin is its very strong airside thermal resistance.

To overcome the low heat exchange capacity of the planar fin, it is known to have recourse to so-called louvered fins, comprising fixed inclined slats spaced apart by openings allowing the air to pass. The advantage of the louvered fin is its low airside thermal resistance. However, the louvered fin has very high pressure drop and can undergo heavy fouling on account of its geometry.

A so-called patterned slat is also known comprising corrugations in the direction of the air flow. The profile of these fins generates zones of turbulence, vectors of strong heat transfer, but also dead zones in the proximity of the tubes where heat transfers are much lower. A variant of this embodiment is illustrated by U.S. Pat. No. 4,434,846 which sets out to guide air in the direction of the tubes, which leads in particular to a pressure loss.

Analysis of known fins leads to ascertaining that the various variants of embodiment of means to increase heat exchanges between the air and fins are not satisfactory in practice.

SUMMARY OF THE INVENTION

The object of the invention is therefore to overcome these disadvantages of known fins by proposing a fin for heat exchanger showing low load loss whilst having an airside thermal resistance that is as low as possible.

To achieve these objectives, the subject of the invention concerns a metal fin for tube heat exchanger, forming an indirect exchange surface intended to increase heat transfer between the tubes, in which a fluid circulates, and the air which circulates between the tubes and along the surface of the fin in a determined flow direction, the fin comprising a series of mounting collars for the tubes and means for increasing heat exchanges between the air and the fin. According to the invention, the means for increasing heat exchanges consist of:

- diverting conformations each arranged upstream of an aperture considering the direction of the air stream, to force the air to pass either side of said aperture;
- diverting conformations which, considering the direction of the air stream, are each arranged downstream of an aperture belonging to a row to force the air to pass either side of apertures belonging to a subsequent row, the upstream and downstream conformations of two superimposed apertures belonging to one same column extending along a determined length to substantially rejoin at the plane of extension of staggered apertures and belonging to an intermediate row with respect to the upstream and downstream rows to which the superimposed apertures belong.

According to the invention, the upstream and downstream diverting conformations are dimensioned so that at air velocities of between 1 and 5 m/s, the fin has an air pressure drop per streamline of between 0.3 and 4 mm WC (water column) respectively, and an airside thermal resistance of between 0.016 and 0.008 $m^2$ K/W respectively.

It is to be considered that the inventive fin has a pressure drop equivalent to that of a planar fin while offering thermal resistance that is greater than with a louvered fin and relatively to close to that of a patterned fin.

According to the invention the upstream diverting conformation and the downstream diverting conformation for one same aperture have mirror symmetry with respect to the plane of extension perpendicular to the direction of the air flow.

According to one characteristic of embodiment, the upstream diverting conformation and the downstream diverting conformation for one aperture are increasingly inclined from the distal edge to the proximal edge of each conformation with respect to the aperture and in the direction of the air flow.

According to another characteristic of embodiment, the width of each diverting conformation increases from its distal edge to its proximal edge.

According to one example of embodiment, each diverting conformation has a substantially semi-elliptical contour.

Preferably, each downstream and upstream conformation has a curved profile along a transverse direction with respect to the flow direction.

Advantageously each diverting conformation is extended at its proximal edge in the direction of the aperture via a deflecting sidewall.

Preferably, in the direction of the air flow, the measurement of the deflecting sidewall is smaller than the measurement of the associated diverting conformation.

According to another characteristic of embodiment, each diverting conformation projects from one side of the fin and is recessed on the other side of the fin.

Another object of the invention is to propose a heat exchanger equipped with a series of inventive metal fins mounted on the circulation tubes of a fluid.

BRIEF DESCRIPTION OF THE DRAWINGS

Various other characteristics will arise from the description given below with reference to the drawings which, as non-restrictive examples, illustrate forms of embodiment of the subject of the invention.

DESCRIPTION OF THE PREFERRED EMBODIMENTS

Figure 1:
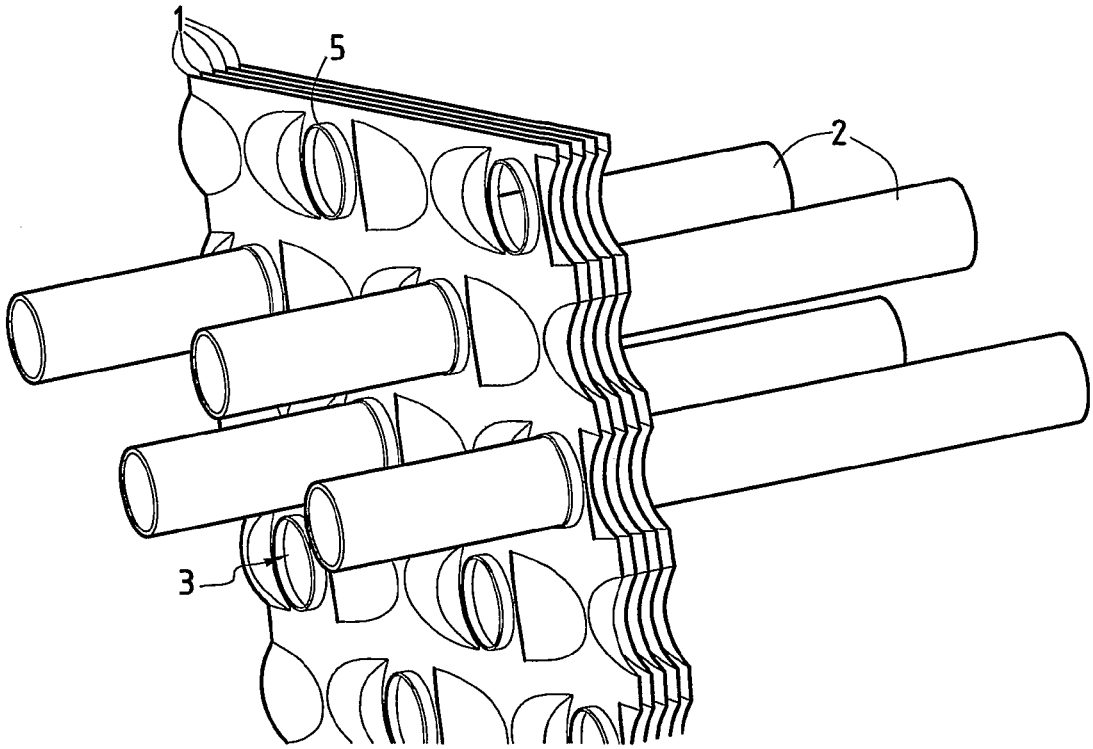
FIG. 1 is a perspective view showing a partial view of the mounting of the inventive fins on tubes to form a heat exchanger.
Figure 2:
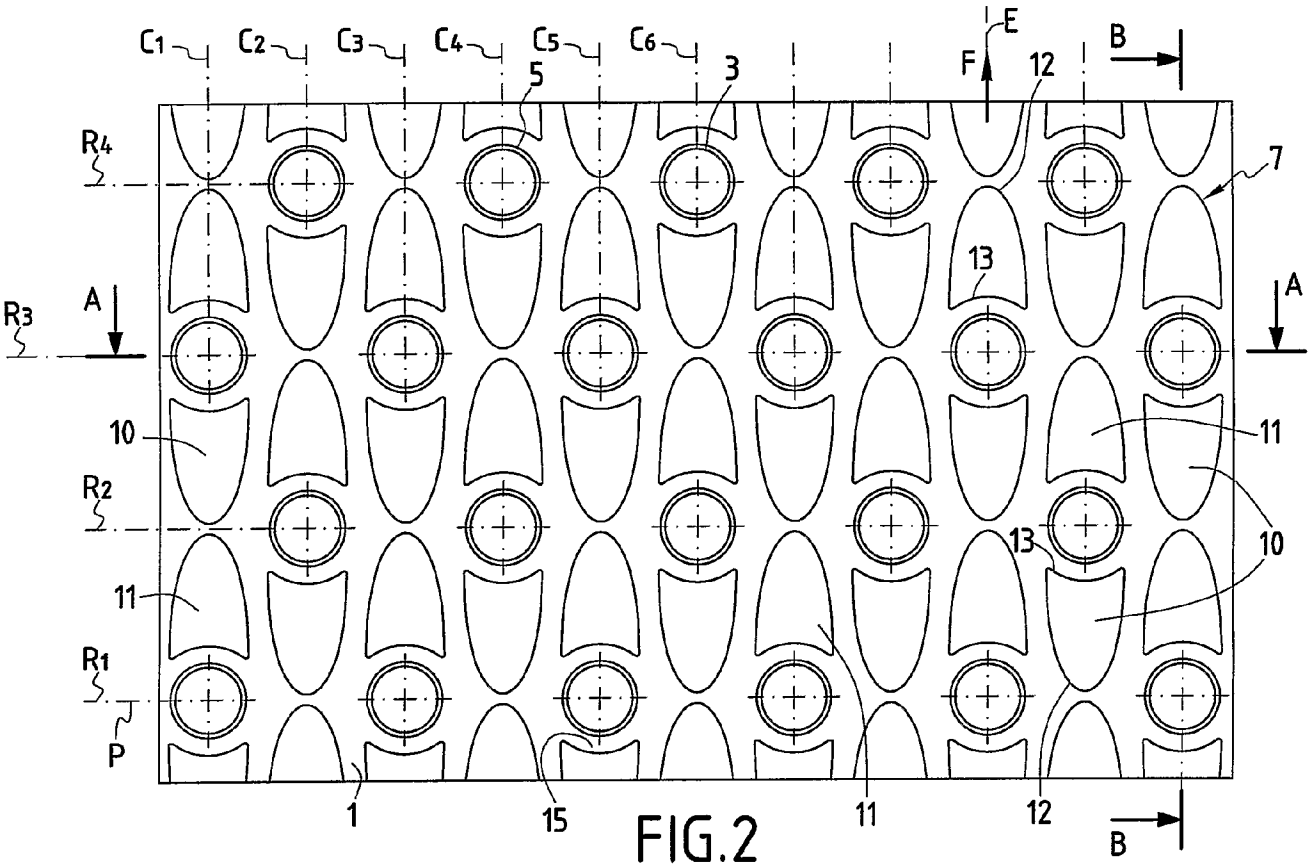
FIG. 2 is a plan view of an inventive fin.

As is clearly shown in FIGS. 1 and 2, the subject of the invention concerns a metal fin 1 intended for use in a heat exchanger, whose purpose is to allow heat transfer between a first fluid such as a coolant circulating inside tubes 2 and a second fluid such as air which circulates outside the tubes 2. The exchange surface, namely the walls of tubes 2 is increased through the use of fins 1 forming indirect exchange surfaces.

Each fin 1 is made from a metal plate e.g. aluminum, an aluminum alloy or copper. In conventional manner, each fin 1 is provided with apertures 3 through which tubes 2 pass. Each aperture 3 is bordered by a collar 5 for mounting a tube 2. In conventional manner the fins 1 are crimped onto the tubes 2 at the collars 5.

The insertion apertures 3 are organized so that they lie in rows $R_1, R_2 \ldots R_i$ parallel to each other and each extending along a plane of extension P which is perpendicular to the direction of the air flow E. In the illustrated example the air flows along a flow direction indicated by arrows F and thereby passes through all the rows R1, R2, . . . Ri forming a streamline. In conventional manner the air flow is pulsed to obtain a flow in a general direction that is substantially rectilinear. After passing through the fins, the air stream exits freely.

Also in conventional manner, the tube insertion apertures 3 are organized so that they extend quincunx fashion. In other words, the apertures 3 of two successive rows are staggered by a determined pitch so as to form a first group of uneven rows ($R_1, R_3, \ldots$), whose apertures 3 are superimposed and distributed over a series of uneven columns ($C_1, C_3, C_5, \ldots$) parallel to the direction of flow E, and a second group of even rows ($R_2, R_4, \ldots$) whose apertures 3 are superimposed and distributed along a series of even columns ($C_2, C_4, C_6, \ldots$) parallel to direction E and each lying between two uneven columns.

Each fin 1 comprises means 7 enabling heat exchanges to be increased between the air and the fin.

According to the invention, the means 7 for increasing heat exchanges consist of diverting conformations 10 each arranged at least upstream of an aperture 3 or collar 5 when considering the direction of air flow E, to force the air to pass either side of said aperture 3 or collar 5 and hence of tube 2 which crosses through said aperture 3. These diverting conformations 10 therefore prevent the air from directly hitting the tube 2, deflecting the air streaks away from it. These so-called upstream diverting conformations 10 make it possible to channel the air on the surface of the fins positioned either side of the apertures 3 and hence either side of the tubes 2.

According to one characteristic of the invention, the means 7 for increasing heat exchanges also comprise diverting conformations 11 each arranged, when considering the direction of air flow E, downstream of an aperture 3 belonging to a row to force the air to pass either side of apertures 3 belonging to a subsequent row. In other words, as can be seen FIG. 2, the diverting conformations 11 made downstream of each aperture 3, e.g. of the first row $R_1$, can channel the air to force it to pass either side of apertures 3 and hence of tubes 2 belonging to the second row $R_2$. It is to be understood that the diverting conformations 10, 11 form projecting or raised surfaces with respect to the plane of the fin promoting the maintained contact of the air with the fin surface whilst channeling the air so that it bypasses tubes 2.

Advantageously, the upstream diverting conformation 10 and the downstream diverting conformation 11, arranged between two successive superimposed apertures 3 belonging to one same column, each extend along a determined length so that they substantially rejoin at the plane of extension P of staggered apertures 3 and belonging to an intermediate row with respect to the upstream and downstream rows to which the two superimposed apertures belong. For example, the downstream 11 and upstream 10 diverting conformations of apertures 3 respectively belonging to the first row $R_1$ and third row $R_3$ of the third column $C_3$ are adapted so that the air can be channeled over the surface of the fin located between apertures 3 of the second row $R_2$ belonging to neighboring columns $C_2$, $C_4$. Said arrangement of diverting conformations makes it possible to reduce dead zones for the air either side of apertures 3 and hence of tubes 2 whilst limiting pressure drops, since the effects of the diverting conformations 10, 11 are reduced at the surface of the fin positioned between two neighboring apertures belonging to neighboring columns. At this surface the air returns to non-disturbed flow since this surface has no or scarcely no conformations.

It is to be considered that the upstream 10 and downstream 11 conformations are sized so that at air velocities of between 1 and 5 m/s the fin 1, per streamline, has an air pressure loss of between 0.3 and 4 mm WC (water column) respectively, and an airside thermal resistance of between 0.016 and 0.008 $m^2$ K/W respectively. The inventive fin 1 therefore has an air pressure loss equivalent to that of a planar fin while its thermal resistance is greater than a louvered fin and relatively to close to that of a patterned fin.

According to one preferred embodiment, the upstream 10 and downstream 11 conformation for one same aperture 3 have mirror symmetry with respect to the plane of extension P of a row of apertures 3 which is perpendicular to the direction of the air flow E. Each upstream 10 and downstream 11 conformation, with respect to an aperture 3, therefore has a distal edge 12 and a proximal edge 13. Advantageously the upstream 10 and downstream 11 conformation are inclined at an angle $\alpha$ which becomes increasingly larger from the distal edge 12 as far as the proximal edge 13 along the direction of air flow E. For example the angle of incline $\alpha$ may lie between 4 and 15° being around 7°. According to this variant of embodiment, it is to be noted that the distal parts 12 of neighboring upstream and downstream conformations belonging to one same column cause practically no air disturbance.

Figure 4:
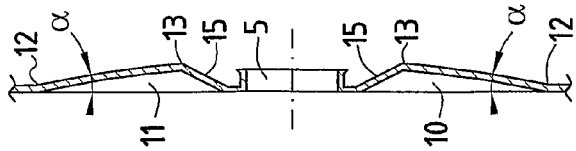
FIG. 4 is a view on a larger scale substantially along lines B-B of FIG. 2.
Figure 3:
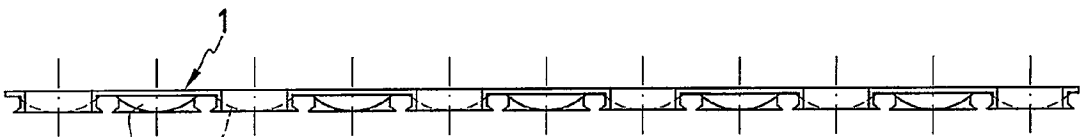
FIG. 3 is a cross-section view along lines A-A of FIG. 2.

As arises more clearly from FIG. 3 each upstream 10 and downstream 11 conformation has a curved profile along a transverse direction with respect to the direction air flow E. Advantageously each upstream 10 or downstream 11 conformation has a width, measured transversally with respect to the direction of air flow E, which increases gradually from its distal edge 12 to its proximal edge 13. As shown more clearly FIG. 2 each upstream 10 or downstream 11 conformation has a substantially semi-elliptical contour. In other words, an upstream 10 and downstream 11 conformation, associated with one same aperture, together have an elliptical contour. Therefore each distal edge 12 or proximal edge 13 of an upstream or downstream conformation has a rounded contour facing the same direction as the corresponding part of aperture 3. Preferably each upstream 10 or downstream 11 conformation is extended from its proximal edge 13 in direction of the aperture 3 by a deflecting sidewall 15 ending at the base of the neighboring collar 5. Each deflecting sidewall 15 is therefore inclined in a direction contrary to the direction of incline of the upstream 10 and downstream 11 conformations. As clearly shown in the figures, the measurement of the deflecting sidewall 15 in the direction of flow E is largely smaller than the measurement of the associated conformation 10, 11 as measured between the distal 12 and proximal 13 edges. In other words, each imprint formed by a deflecting sidewall 15 and an upstream 10 or downstream 11 conformation has a dissymmetrical profile along the direction of flow E as shown FIG. 4.

As follows from the above description, the upstream 10 and downstream 11 conformations project from one side of the fin and are recessed on the other side of the fin. Said fins 1 are intended to be mounted alongside each other each being oriented in the same direction, to form a heat exchanger.

The invention is not limited to the described, illustrated examples since various modifications can be made thereto without departing from the scope of the invention.

The invention claimed is:

1. Metal fin for a tube heat exchanger which forms an indirect exchange surface for increasing heat transfer between the tubes mounted in the fin, in which a fluid circulates, and air circulating between the tubes and along a fin surface in a predetermined flow direction, the fin comprising:

a plurality of mounting apertures for receiving the tubes, disposed co-linearly in a plurality of spaced apart rows and a plurality of spaced apart columns, the apertures in adjacent rows being staggered such that the apertures in adjacent rows do not overlap, and the apertures in adjacent columns being staggered such that the apertures in adjacent columns do not overlap, each said mounting aperture being surrounded by a collar, and means for increasing heat exchange between the flowing air and the fin, the means for increasing heat exchange comprising a pair of diverting conformations for each of said apertures, said pair of diverting conformations comprising a first diverting conformation arranged upstream of an aperture in the flow direction to force flowing air to pass either side of said aperture, and a second diverting conformation arranged downstream of an aperture in the flow direction to force flowing air to pass either side of apertures in an adjacent row, the first and second diverting conformations being arranged co-linearly with the aperture therebetween in a column, with first and second diverting conformations of adjacent apertures in a column substantially rejoining at a plane of extension of apertures in an adjacent column, the first and second diverting conformation for an aperture having mirror symmetry in the plane of extension, each said diverting conformation projecting from the surface of the fin and being recessed with respect to an opposite surface of the fin, and each said diverting conformation having an edge proximal to a respective aperture and an edge distal to the respective aperture, with each said diverting conformation increasing in width and inclination from the distal edge to the proximal edge in a direction perpendicular to the plane of extension, and forming thereby a substantially semi-elliptical contour.

2. Metal fin as in claim 1, wherein the first and second diverting conformations are sized so that at air velocities of between 1 and 5 m/s, the fin, per streamline, has an air pressure loss of between 0.3 and 4 mm WC (water column) respectively and an airside thermal resistance of between 0.016 and 0.008 $m^2$ K/W respectively.

3. Metal fin as in claim 1, wherein each diverting conformation has a curved profile in a transverse direction with respect to the flow direction.

4. Metal fin as in claim 1, wherein each diverting conformation is extended from the proximal edge towards the aperture by a deflecting sidewall.

5. Metal fin as in claim 4, wherein the deflecting sidewall has a measurement in the flow direction smaller than the a measurement in the flow direction from the proximal edge to the distal edge of the diverting conformation.

6. Heat exchanger comprising a plurality of metal fins according to claim 1, and mounted on tubes in which a fluid circulates.

* * * * *